US009383163B2

(12) United States Patent
Kincel et al.

(10) Patent No.: US 9,383,163 B2
(45) Date of Patent: Jul. 5, 2016

(54) FIREARM ACCESSORY KEYHOLE LOCKING INTERFACE

(71) Applicant: Bravo Company USA, Inc., Hartland, WI (US)

(72) Inventors: Eric Stephen Kincel, Las Vegas, NV (US); Jeff James O'Brien, Las Vegas, NV (US)

(73) Assignee: Bravo Company USA, Inc., Hartland, WI (US)

( * ) Notice: Subject to any disclaimer, the term of this patent is extended or adjusted under 35 U.S.C. 154(b) by 0 days.

(21) Appl. No.: 14/152,889

(22) Filed: Jan. 10, 2014

(65) Prior Publication Data

US 2015/0198408 A1 Jul. 16, 2015

(51) Int. Cl.
*F41C 23/16* (2006.01)

(52) U.S. Cl.
CPC ..... *F41C 23/16* (2013.01)

(58) Field of Classification Search
CPC ..... F41C 23/12–23/14
USPC ..... 42/72
See application file for complete search history.

(56) References Cited

U.S. PATENT DOCUMENTS 2,078,010 A * 4/1937 Meepos ..... F41C 23/02 24/265 CD
2,102,964 A 12/1937 Mosseberg
3,066,375 A * 12/1962 Knowles ..... F41C 23/02 24/639
3,559,940 A 2/1971 Kruzell
3,798,818 A 3/1974 Casull
5,048,215 A * 9/1991 Davis ..... F41A 35/06 42/71.01
7,325,352 B2 * 2/2008 Matthews ..... F41G 11/003 362/110
7,464,495 B2 * 12/2008 Cahill ..... F41C 23/12 42/72
7,712,242 B2 * 5/2010 Matthews ..... F41G 11/003 248/229.11
7,770,317 B1 8/2010 Tankersley
8,245,428 B2 * 8/2012 Griffin ..... F41C 23/16 42/72
8,438,770 B2 5/2013 Troy
8,607,490 B1 12/2013 Zinsner
8,739,448 B2 6/2014 Kimmel et al.
8,752,320 B2 6/2014 Masters
D720,421 S 12/2014 Chen
8,904,691 B1 12/2014 Kincel
D722,356 S 2/2015 Keller et al.
9,103,625 B2 8/2015 Masters (Continued)

FOREIGN PATENT DOCUMENTS

WO WO 2013/010515 1/2013

OTHER PUBLICATIONS

U.S. Appl. No. 14/173,770 Office Action mailed Sep. 30, 2015.

*Primary Examiner* — Troy Chambers
*Assistant Examiner* — Bridget Cochran
(74) *Attorney, Agent, or Firm* — Lewis Roca Rothgerber Christie LLP

(57) ABSTRACT

A keyhole mounted accessory system, the system comprising a main body coupled to an intermediate body, the intermediate body having a base that contains a large hollow cylinder. The large hollow cylinder contains a small hollow cylinder. A bolt protrudes from a first end of the main body through the small hollow cylinder and the large hollow cylinder. A cylindrical rotor having a round aperture in the center contains one or more helical pads is coupled to a top plate by one or more anchors. The top plate includes one or more helical recesses that interface with the one or more helical pads. The one or more anchors secure the top plate to the intermediate body.

20 Claims, 31 Drawing Sheets

(56) References Cited

U.S. PATENT DOCUMENTS

| | | | | |
|---|---|---|---|---|
| 2009/0100734 | A1 | 4/2009 | Swan et al. | |
| 2010/0242332 | A1 * | 9/2010 | Teetzel | F41A 23/08 42/72 |
| 2011/0126443 | A1 | 6/2011 | Sirois | |
| 2012/0124880 | A1 | 5/2012 | Leclair | |
| 2012/0167434 | A1 | 7/2012 | Masters | |
| 2012/0186123 | A1 | 7/2012 | Troy et al. | |
| 2014/0026459 | A1 | 1/2014 | Yan et al. | |
| 2014/0041273 | A1 | 2/2014 | Masters | |
| 2014/0115939 | A1 * | 5/2014 | Troy | F41C 23/16 42/72 |
| 2014/0130390 | A1 | 5/2014 | Geissele | |
| 2015/0219422 | A1 | 8/2015 | Kincel | |

* cited by examiner

FIREARM ACCESSORY KEYHOLE LOCKING INTERFACE

BACKGROUND

1. Field of the Invention

The present invention generally concerns firearm equipment. More particularly, the present invention relates to mechanisms for locking accessories to firearm accessory rails.

2. Description of the Related Art

Traditionally, an accessory such as a keyhole mounted accessory has been attached to AR-15 and M-16 firearms by mounting directly to a Military Standard 1913 Picatinny Arsenal rail design ("Picatinny rail"), which is coupled to the barrel of the firearm. There are numerous ways to mount an accessory to a Picatinny rail, some of which are described herein.

One method of locking an accessory to a Picatinny rail uses a slide-on mechanism. For example, the top of an accessory may contain a groove into which the bottom edge of the rail can slide. The accessory locks into the rail by way of a "screw-core" locking mechanism. The center of the grip, when tightened, is raised into one of the holes in the Picatinny rail and locks the accessory into place.

A similar method uses a rotating accessory body. The top of the accessory also contains grooves, but rather than sliding on to the Picatinny rail, the accessory rotates onto the edge of the rail and then locks into place using the screw-core method.

The simplest way of mounting an accessory to a Picatinny rail is by using a screw on the side of the accessory. In general, the screw indexes and compresses the accessory material to the rail. However, there are different methods of installing the accessory before tightening the screw. The rail may slide onto the accessory ("slide-on" method), the rail may be dropped into an opening or groove on the accessory ("drop-on" method), or a moving clamp may be used to connect the accessory to the rail. Some designs utilize a thumb knob instead of screw for tightening the accessory to the rail.

Alternatively, the accessory may be attached to the rail by using a throw-lever tensioning device in combination with a drop-on method and a clamp.

As mentioned, attaching the accessory to a Picatinny rail is the most popular locking method. However, some designs do not utilize the Picatinny rail because users may not always use a Picatinny rail on their firearms. For example, some designs utilize bolts to attach the accessory. Other similar designs using screws also have been used in the industry. The earliest uses of these designs date back to World War I.

Although each of these methods is effective for mounting the accessory to a firearm, including methods with or without utilizing a Picatinny rail, none of them is effective for mounting an accessory, such as a keyhole mounted accessory, to a firearm that utilizes an accessory rail that uses a certain hole configuration. For example, KeyMod™ rail and hole configuration is used herein as an exemplary system. Therefore, there is a need for mechanisms that lock an accessory to a modular accessory rail easily and securely.

SUMMARY OF THE CLAIMED INVENTION

In one embodiment, a keyhole mounted accessory for a firearm is disclosed. The keyhole mounted accessory uses anchors that fit in modular holes on a handguard. The keyhole mounted accessory is made up of a basic body, the upper end of which is attached to an intermediate grip body. The intermediate body is attached to a rotor that has helical pads on its top side. A screw is threaded through the rotor, the intermediate body, and the grip body through a number of holes. Finally, a top plate is secured to the rotor. The underside of the top plate contains recesses. When the top plate is placed on top of the grip body, the recesses interface with the helical pads, allowing the user to rotate the grip body and the top plate at the same time. The accessory can be attached to a handguard that contains modular holes ("keyholes") because the top plate contains anchors designed to fit into the wide portion of a modular hole. This allows the user to slide the keyhole mounted accessory forward to lock it in place.

An alternative embodiment has a grip body with a top plate that contains a slit into which an anchor beam fits. The anchor beam has an anchor that protrudes from the top. A circular portion of a throw lever fits through the slit and covers a portion of the anchor beam. The circular portion has rotary cuts that fit into depressions on the bottom of the anchor beam. The arm of the throw lever connects to the top of the grip body. A retainer with a recoil lug secures the throw lever to the top plate using a plug.

Yet another embodiment has a grip body with a top plate that contains a slit. A threaded plug has a recoil lug on the top and is attached to two semi-circular plates of different heights. A circular portion of a throw lever has a circular threaded hole in the middle into which the threaded plug fits. The grip body and the plug are held in place by a roll pin. An anchor beam has anchors protruding from the top. The anchors lock into the semi-circular plates.

DETAILED DESCRIPTION

Embodiments of the present invention provide keyhole mounted firearm accessories, and systems and methods of locking the grips to a firearm. Persons of ordinary skill in the art will realize that the following description of the presently invention is illustrative only and not in any way limiting. Other embodiments of the invention will readily suggest themselves to such skilled persons.

Although the embodiments of the present invention illustrate the locking mechanisms inside vertical firearm grip, it is contemplated that the locking mechanisms may be utilized to attach any accessory designed for mounting on an accessory rail, including for example lights mounts, optic mounts, bipod mounts, sling mounts, infrared/laser aiming device, and similar accessories.

It is contemplated that any handguard that contains modular holes may be used in connection with the present invention. In a preferred embodiment, the handguard is made from magnesium rather than aluminum, the typical material for handguards in the industry. Magnesium is lighter than aluminum by a ratio of 1:3, and is therefore an ideal structural material for handguards because it reduces strain on the firearm user during use. However, handguards made from any suitable structural material may be used in connection with the present invention, including without limitation steel (carbon and stainless), aluminum, and titanium. An exemplary firearm used in connection with this invention may include an AR15, M16, M4, 416, or a variant thereof.

Rotating Keyhole Mounted Accessory with Anchors and Helical Pads

Figure 1A:
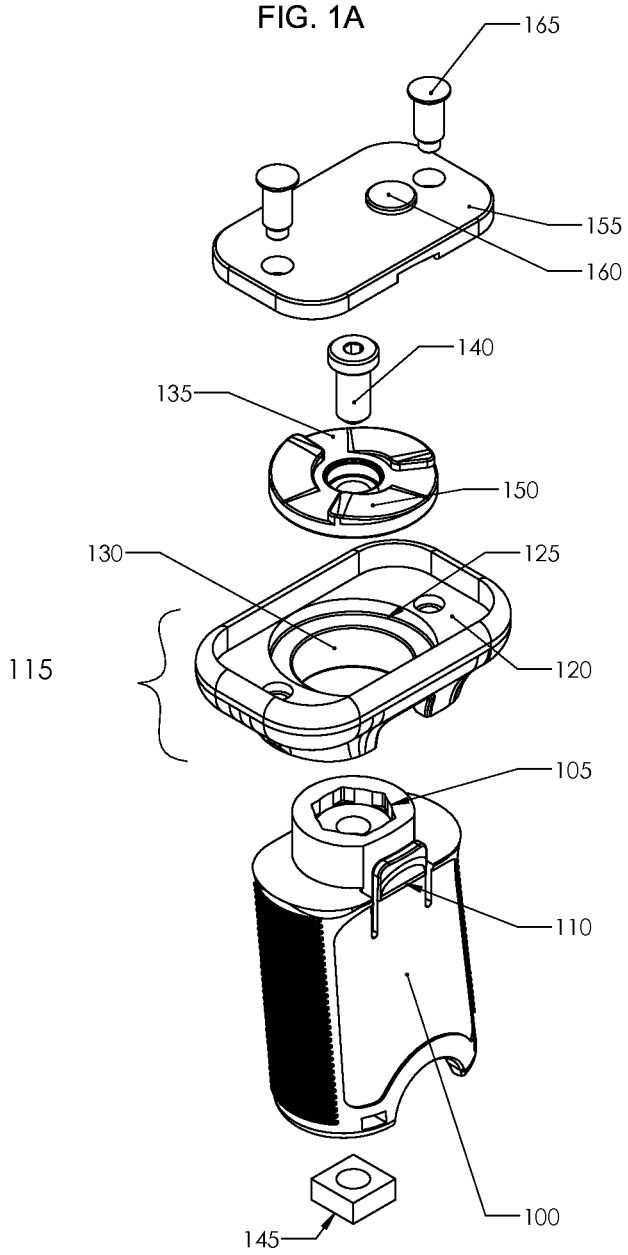
FIG. 1A illustrates a top-down exploded view of an exemplary keyhole mounted accessory using anchors and helical pads.

Referring now to FIG. 1A, illustrating a top-down exploded view of an exemplary keyhole mounted accessory using anchors and helical pads, a grip body 100 (which would be the main body of a different type of accessory) has a bolt 105 protruding from the top. Grip body 100 also has an integrated tab 110 that interfaces with intermediate body 115. When grip body 100 is fully rotated, tab 110 interlocks with a void in intermediate body 115 to prevent further rotation.

The upper portion of intermediate body 115 is hollow and contains base 120. Intermediate body 115 contains a large hollow cylinder 125, which creates an aperture in base 120. The inside of large cylinder 125 contains a small hollow cylinder 130, into which bolt 105 may be inserted. Small hollow cylinder 130 creates an aperture in large cylinder 125 as well as an aperture in the bottom of intermediate body 115.

Rotor 135 is a solid cylinder with a round aperture in its core, into which screw 140 may be inserted. Screw 140 is then threaded through large cylinder 125, small cylinder 130, and bolt 105. Screw 140 is secured by a nut 145 inside grip body 115. Rotor 135 contains one or more helical pads, one of which is labeled 150.

Rotor 135 is coupled to top plate 155, which contains recoil lug 160. Top plate 155 is affixed to intermediate body 115 by one or more anchors, such as a KeyMod™ anchor, one of which is labeled 165. Top plate 155 contains one or more apertures through which anchors 165 may be threaded.

Figure 1B:
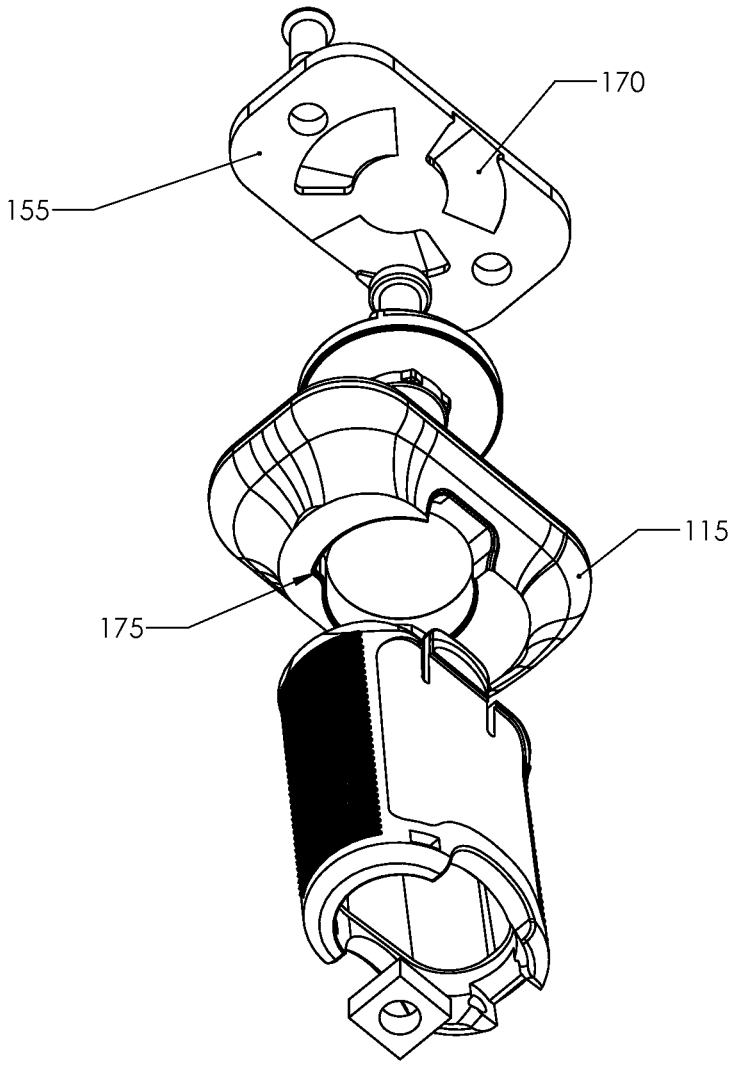
FIG. 1B illustrates a bottom-up exploded view of an exemplary keyhole mounted accessory using anchors and helical pads.

Referring now to FIG. 1B, illustrating a bottom-up exploded view of an exemplary keyhole mounted accessory using anchors and helical pads, the underside of top plate 155 may contain one or more helical recesses, one of which is labeled 170, which interface with helical pads 150. When fully assembled, the grip body 100 can be rotated by the user, which in turn rotates helical pads 150 interfaced with helical recesses 170, which in turn rotates top plate 155.

As shown in FIG. 1B, intermediate body 115 may further contain turn relief 175. When grip body 100 is screwed to intermediate body 115, turn relief 175 prevents rotation past a certain point (e.g., ¼ or ½ turn) to secure the assembly in place.

Figure 1C:
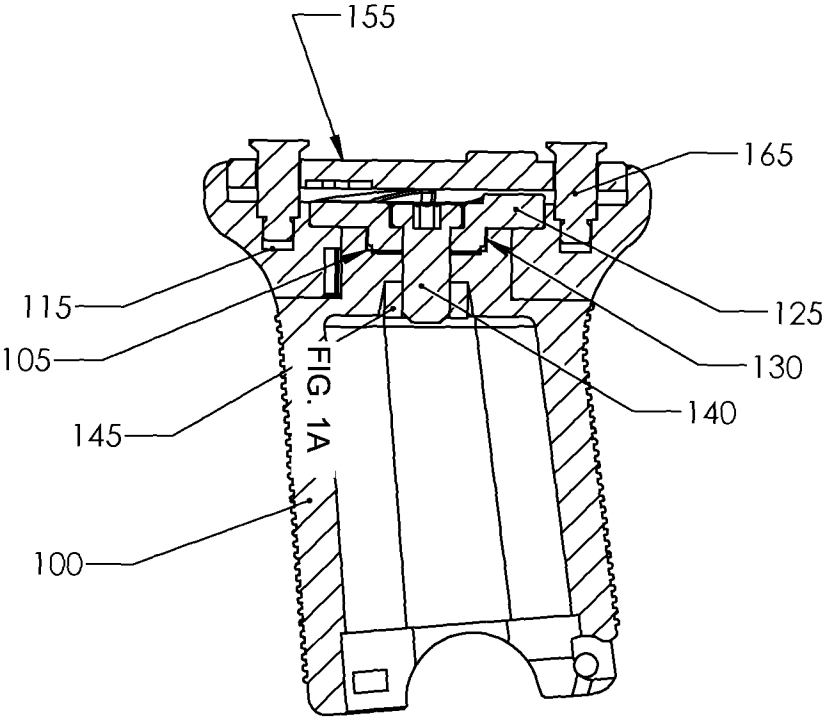
FIG. 1C illustrates a cross-sectional view of an exemplary fully assembled keyhole mounted accessory using anchors and helical pads.

FIG. 1C illustrates a cross-sectional view of an exemplary fully assembled keyhole mounted accessory using anchors and helical pads. According to FIG. 1C, grip body 100 is coupled to intermediate body 115 by way of screw 140. Screw 140 is threaded through large hollow cylinder 125 and small hollow cylinder 130, before being secured to grip body 100 by bolt 105 and nut 145. Also shown in FIG. 1C, top plate 155 is affixed to intermediate body 115 by anchors 165.

Figure 1D:
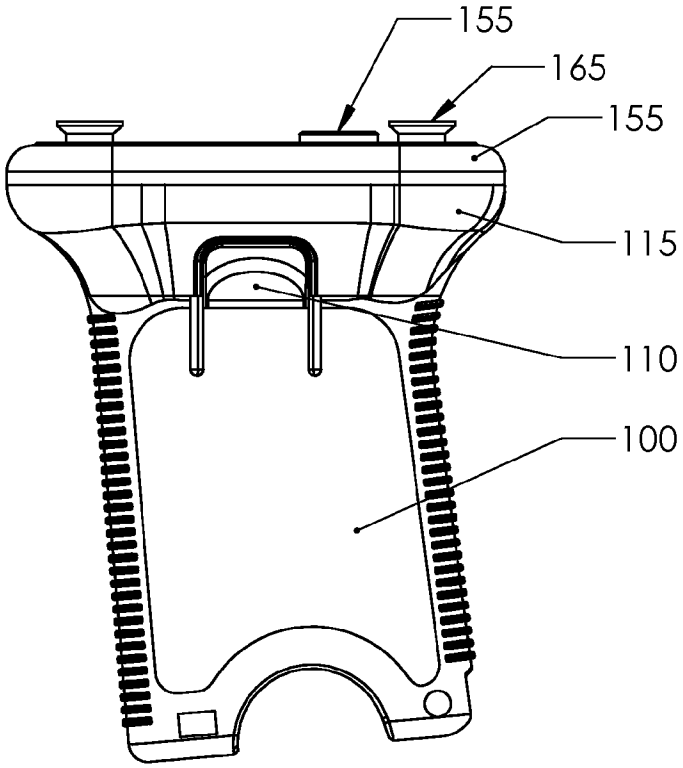
FIG. 1D illustrates a side view of an exemplary fully assembled keyhole mounted accessory using anchors and helical pads.

Referring now to FIG. 1D, illustrating a side view of a fully assembled keyhole mounted accessory using anchors and helical pads, anchors 165 protrude from the top of top plate 155. Grip body 100 is secured to intermediate body 115 and held in place using interlocking integrated tab 110.

Figure 1E:
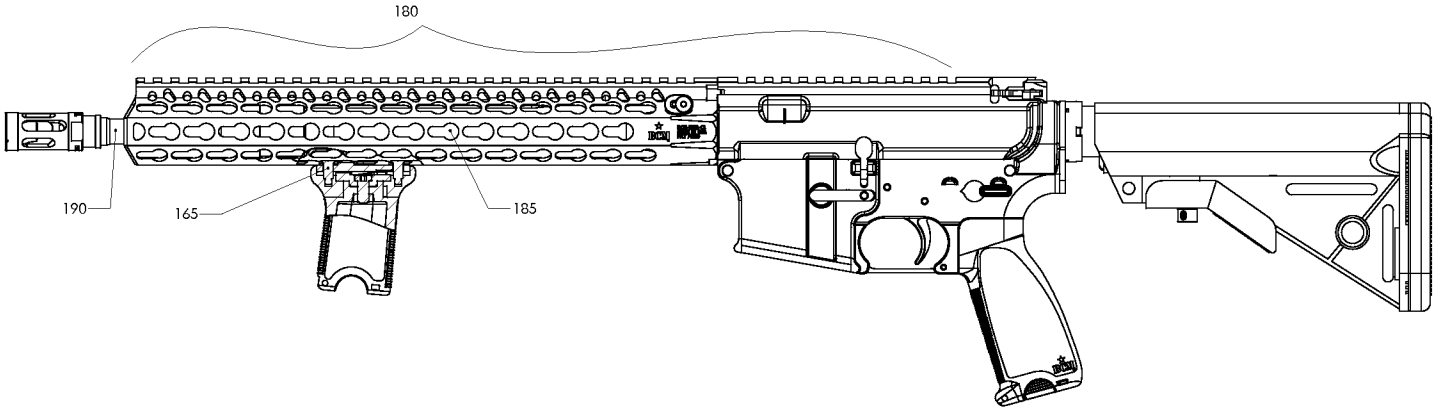
FIG. 1E illustrates a cross-sectional view of an exemplary fully assembled keyhole mounted accessory mounted to an exemplary firearm using anchors and helical pads.

Referring now to FIG. 1E, illustrating a cross-sectional view of a fully assembled keyhole mounted accessory mounted to an exemplary firearm using anchors and helical pads, anchors 165 are secured to an accessory rail 180. The head of an anchor 165 fits through the circular portion of a hole 185. When the user slides grip body 100 forward (toward the end of the firearm barrel 190) on the accessory rail 180, the body of anchor 165 interfaces with the narrow portion of hole 185, securing the anchor in place. The user may remove the keyhole mounted accessory by sliding grip body 100 backward (toward the firearm stock 195) and lowering the head of anchor 165 out of the circular portion of hole 185 of accessory rail 180.

Keyhole Mounted Accessory with Anchor Beam and Throw Lever

Figure 2A:
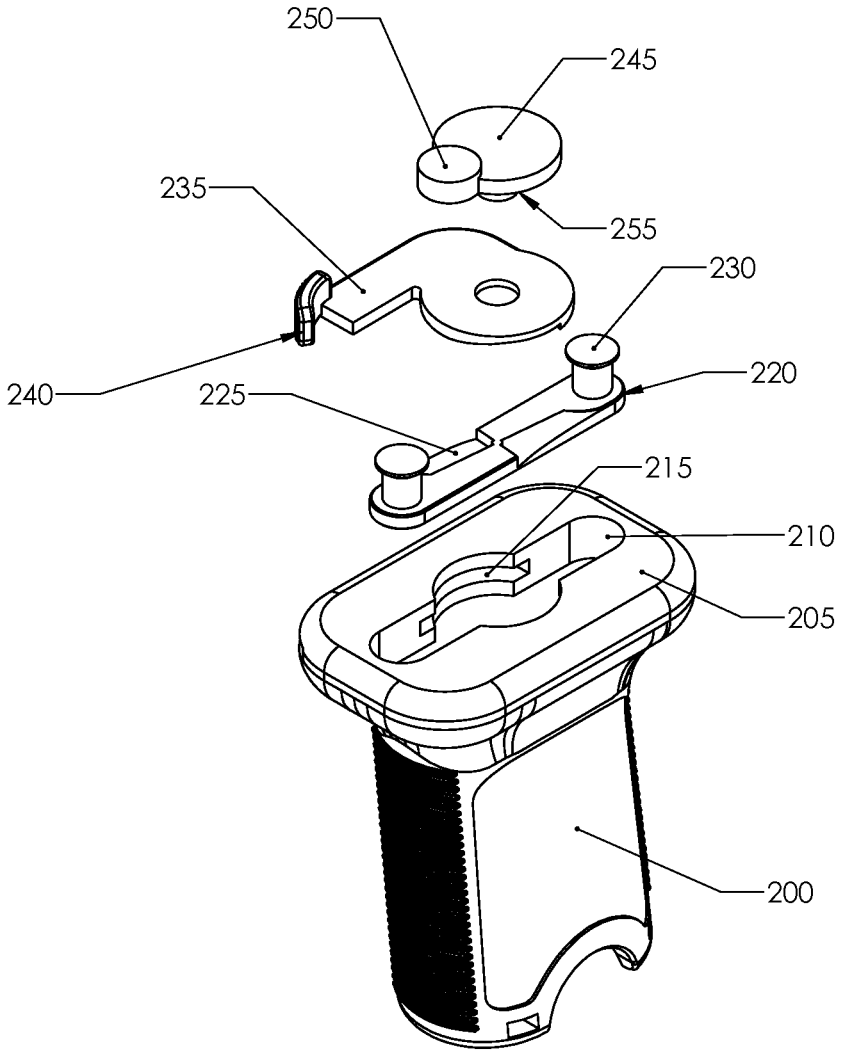
FIG. 2A illustrates a top-down exploded view of an exemplary keyhole mounted accessory using an anchor beam and a throw lever.

Referring now to FIG. 2A, illustrating a top-down exploded view of an exemplary keyhole mounted accessory using an anchor beam and a throw lever, a grip body 200 (which would be the main body of a different type of accessory) has an integrated top plate 205. Top plate 205 has an aperture 210 containing a slit 215 that creates a void between the inside of aperture 210 (shown) and the outside wall of grip body 200 (not shown). Anchor beam 220 may be lowered into aperture 210. The top of anchor beam 220 contains depressions, one of which is labeled 225, as well as at least one protruding anchor, one of which is labeled 230. After anchor beam 220 is lowered, the circular portion of throw lever 235, which contains a circular aperture in its center, is placed through slit 215 and covers the top middle portion of anchor beam 220. When closed, tab 240 on the narrow arm of throw lever 235 interfaces with the top of grip body 200 and the edge of top plate 205. A retainer 245 with an integrated recoil lug 250 secures throw lever 235 to top plate 205 by way of a plug 255 that fits into the circular aperture of throw lever 235.

Figure 2B:
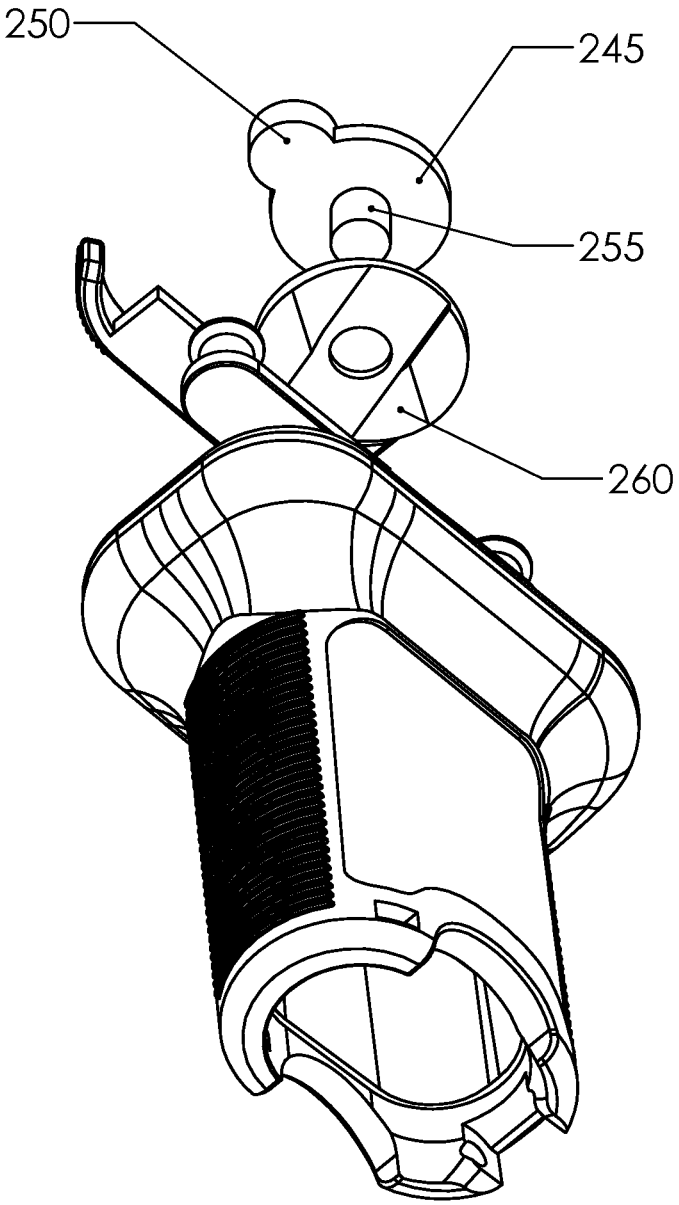
FIG. 2B illustrates a bottom-up exploded view of an exemplary keyhole mounted accessory using an anchor beam and a throw lever.

Referring now to FIG. 2B, illustrating a bottom-up exploded view of an exemplary keyhole mounted accessory using an anchor beam and a throw lever, plug 255 is shown on the underside of retainer 245. According to FIG. 2B, the underside of the circular portion of throw lever 235 contains at least one rotary cut, one of which is labeled 260. When throw lever 235 is lowered onto anchor beam 220 as described in FIG. 2A, the raised portions of anchor beam 220 interface with rotary cuts 260, and depressions 225 interface with the raised portions of the underside of the circular portion of throw lever 235.

According to FIGS. 2A and 2B, throw lever 235 uses rotary action to depress anchor beam 220 with anchors 230.

Figure 2C:
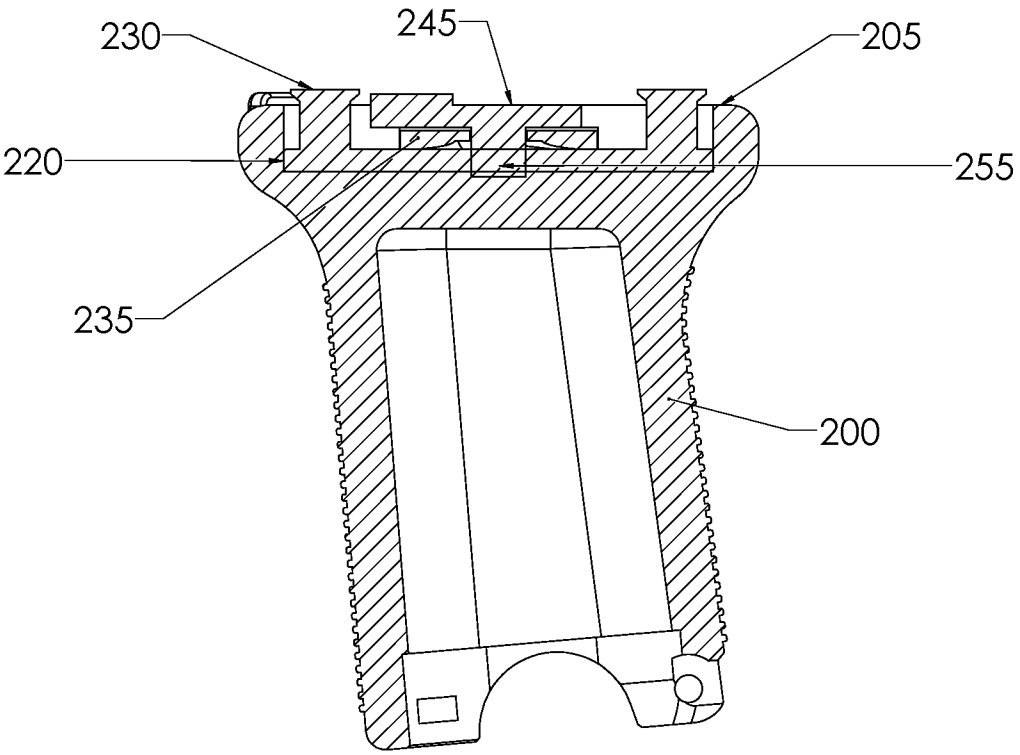
FIG. 2C illustrates a cross-sectional view of an exemplary fully assembled keyhole mounted accessory using an anchor beam and a throw lever.

Referring now to FIG. 2C, illustrating a cross-sectional view of an exemplary fully assembled keyhole mounted accessory using an anchor beam and a throw lever, anchor beam 220 is depressed into the aperture in top plate 205 of grip body 200 by way of the circular portion of throw lever 235. Throw lever 235 is held in place by retainer 245, which contains plug 255 that fits through a circular aperture in the center of the circular portion of throw lever 235. In the depressed position shown in FIG. 2C, anchors 230 are lowered such that they are nearly flush with top plate 205.

Figure 2D:
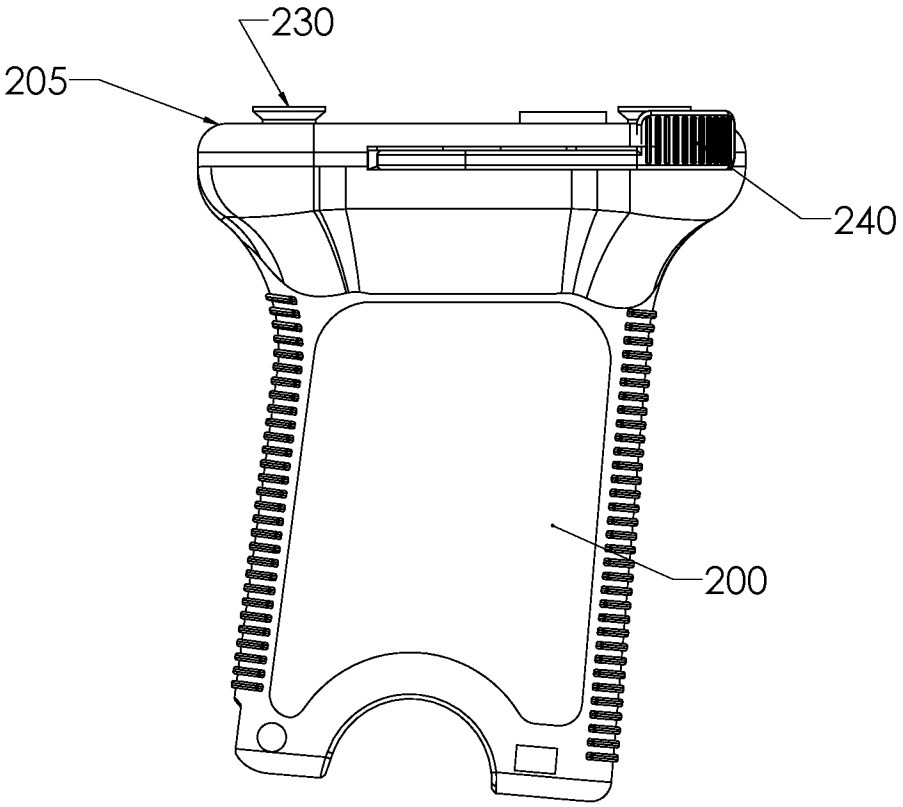
FIG. 2D illustrates a side view of an exemplary keyhole mounted accessory using an anchor beam and a throw lever.

Referring now to FIG. 2D, illustrating a side view of an exemplary keyhole mounted accessory using an anchor beam and a throw lever, throw lever 235 is shown in the closed position. Tab 240 on the narrow arm of throw lever 235 interfaces with the top of grip body 200 and the edge of top plate 205. Anchors 230 as thus depressed, and are lowered such that they are nearly flush with top plate 205.

Figure 2E:
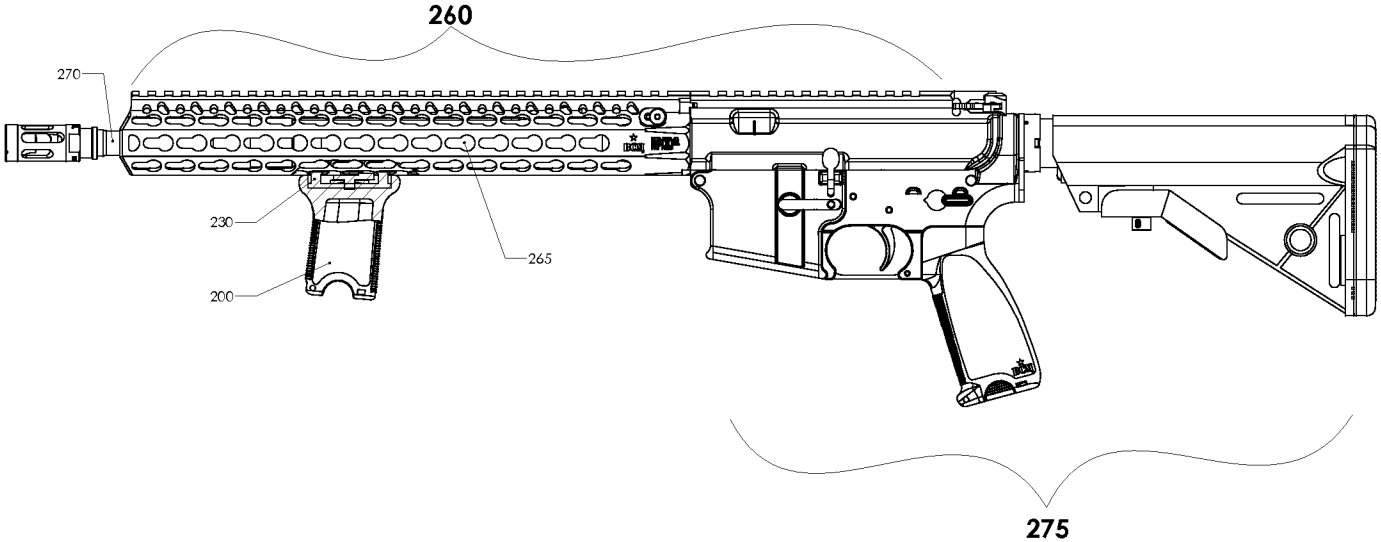
FIG. 2E illustrates a cross-sectional view of an exemplary fully assembled keyhole mounted accessory mounted to an exemplary firearm using an anchor beam and throw lever.

Referring now to FIG. 2E, illustrating a cross-sectional view of an exemplary fully assembled keyhole mounted accessory mounted to an exemplary firearm using an anchor beam and throw lever, throw lever 235 is shown in the open position. Anchors 230 are secured to an accessory rail 260. The head of an anchor 230 fits through the circular portion of a hole 265. When the user slides grip body 200 forward (toward the end of the firearm barrel 270) on the accessory rail 260, the body of anchor 230 interfaces with the narrow portion of hole 265, securing the anchor in place. The user may remove the keyhole mounted accessory by sliding grip body 200 backward (toward the firearm stock 275) and lowering the head of anchor 230 out of the circular portion of hole 265 of accessory rail 260.

Keyhole Mounted Accessory with Throw Lever with Helical Pads

Figure 3A:
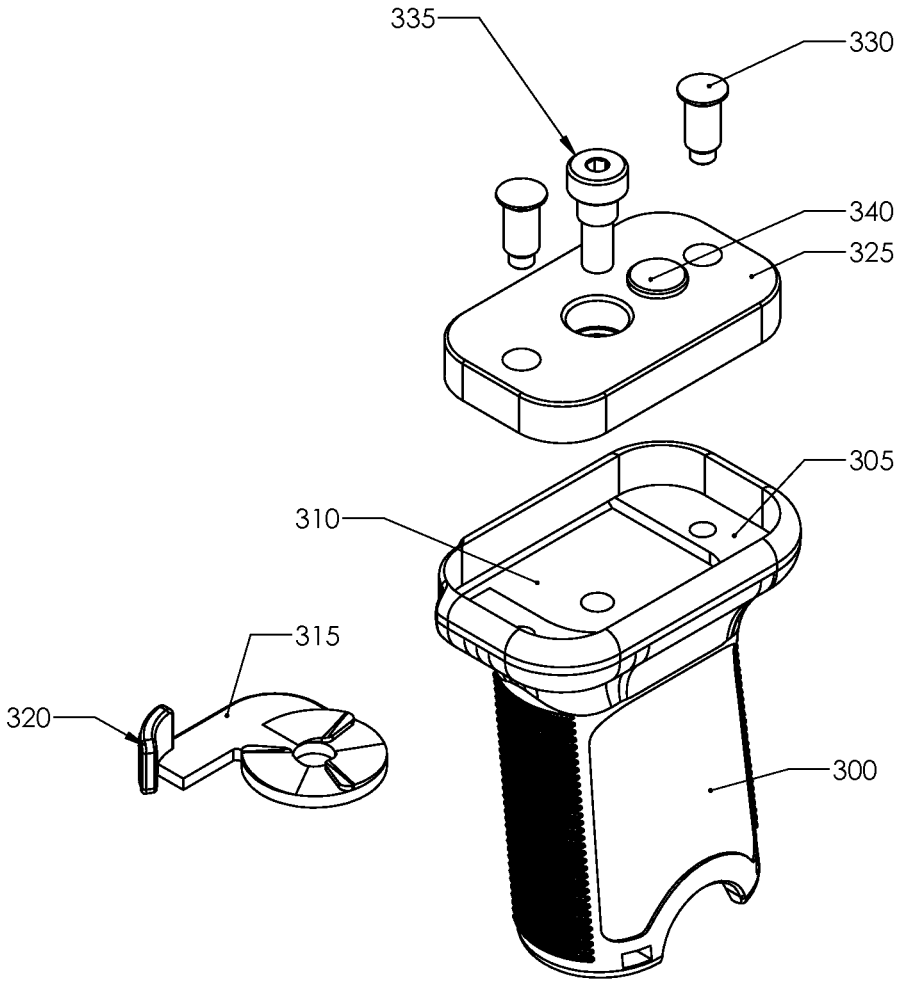
FIG. 3A illustrates a top-down exploded view of an exemplary keyhole mounted accessory using a throw lever with helical pads.

Referring now to FIG. 3A, illustrating and exploded view of an exemplary keyhole mounted accessory using a throw lever with helical pads, a grip body 300 (which would be the main body of a different type of accessory). The upper portion of grip body 300 is hollow and contains base 305, which contains void 310 that creates an aperture in the side wall of grip body 300. A circular portion of throw lever 315 may be placed through the aperture of the side wall of grip body 300 to fit into the void 310. The top of the circular portion of throw lever 315 contains one or more helical pads. An arm portion of throw lever 315 contains a tab 320 that interfaces with grip body 300 when the throw lever is in the closed position.

Top plate 325 may be lowered into hollow grip body 300. Top plate 325 has apertures through which anchors, one of which is labeled 330, may be threaded, an aperture through which a screw 335 may be threaded, and an integrated recoil lug 340. When top plate 325 is lowered into hollow grip body 300, the screw 335 secures top plate 325 to the grip body 300.

Figure 3B:
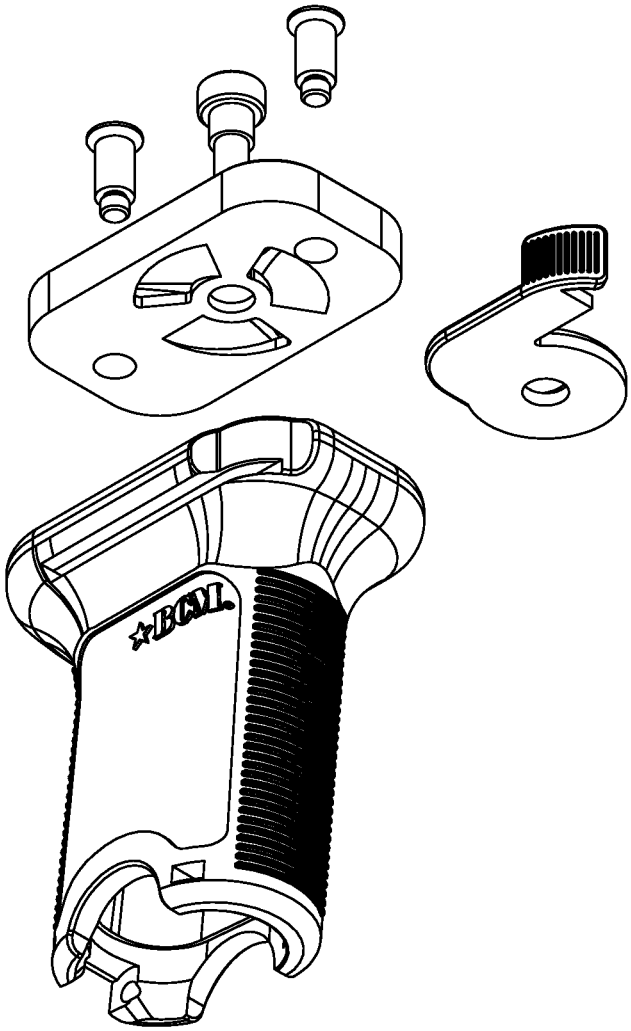
FIG. 3B illustrates a bottom-up exploded view of an exemplary keyhole mounted accessory using a throw lever with helical pads.

Referring now to FIG. 3B, illustrating a bottom-up exploded view of an exemplary keyhole mounted accessory using a throw lever with helical pads, the underside of top plate 325 contains at least one helical recess. According to FIGS. 3A and 3B, throw lever 315 uses rotary action to raise anchors 330 when at least one helical pads interface with the at least one helical recess. When throw lever 315 is closed, the at least one helical pads interface with the at least one helical recess.

Figure 3C:
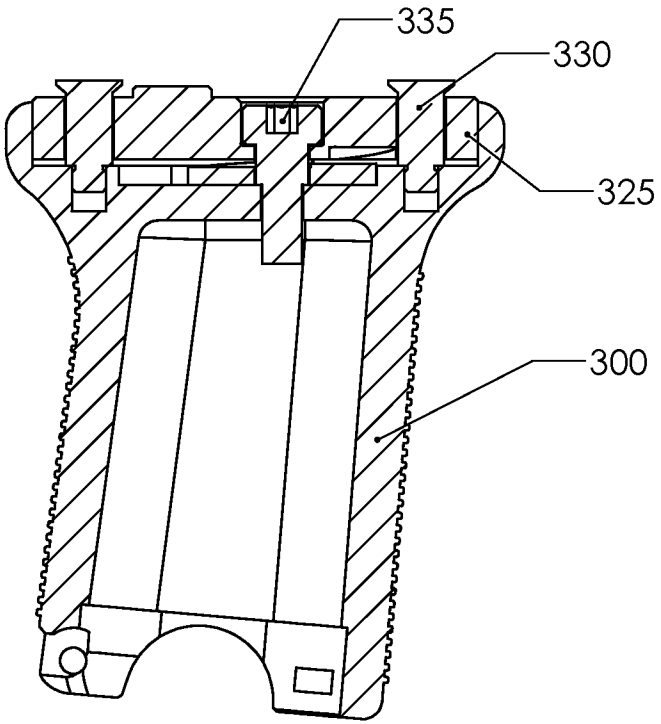
FIG. 3C illustrates a cross-sectional view of an exemplary fully assembled keyhole mounted accessory using a throw lever with helical pads.

Referring now to FIG. 3C, illustrating a cross-sectional view of an exemplary fully assembled keyhole mounted accessory using a throw lever, top plate 325 is depressed into the aperture in grip body 300 by way of the circular portion of throw lever 315. Throw lever 315 is held in place by screw 335. In the depressed position shown in FIG. 3C, anchors 330 are lowered such that they are nearly flush with top plate 325.

Figure 3D:
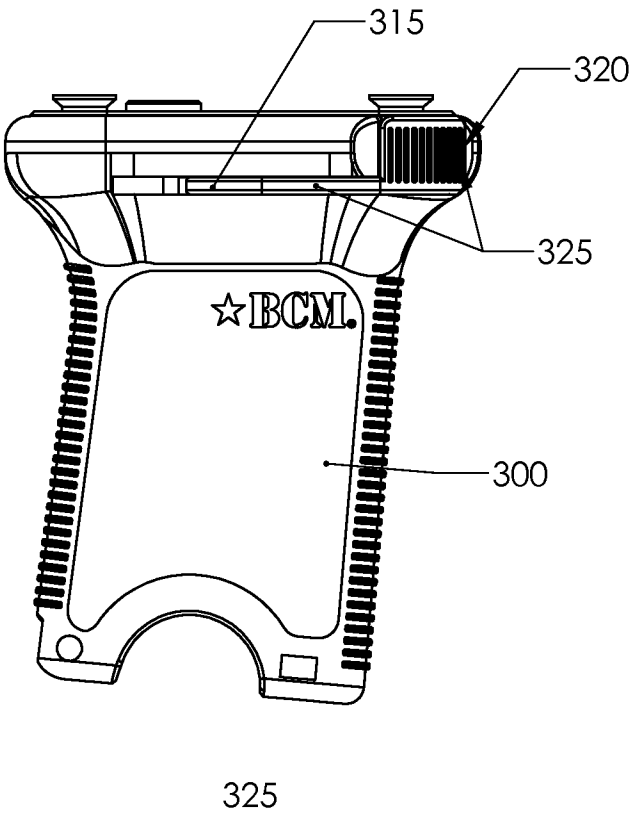
FIG. 3D illustrates a side view of an exemplary keyhole mounted accessory using an anchor beam and throw lever with helical pads.

Referring now to FIG. 3D, illustrating a side view of an exemplary keyhole mounted accessory using an anchor beam and a throw lever, throw lever 325 is shown in the closed position. Tab 320 on the narrow arm of throw lever 315 interfaces with the top of grip body 300 and the edge of top plate 325. Anchors 330 are thus depressed, and are lowered such that they are nearly flush with top plate 325.

Figure 3E:
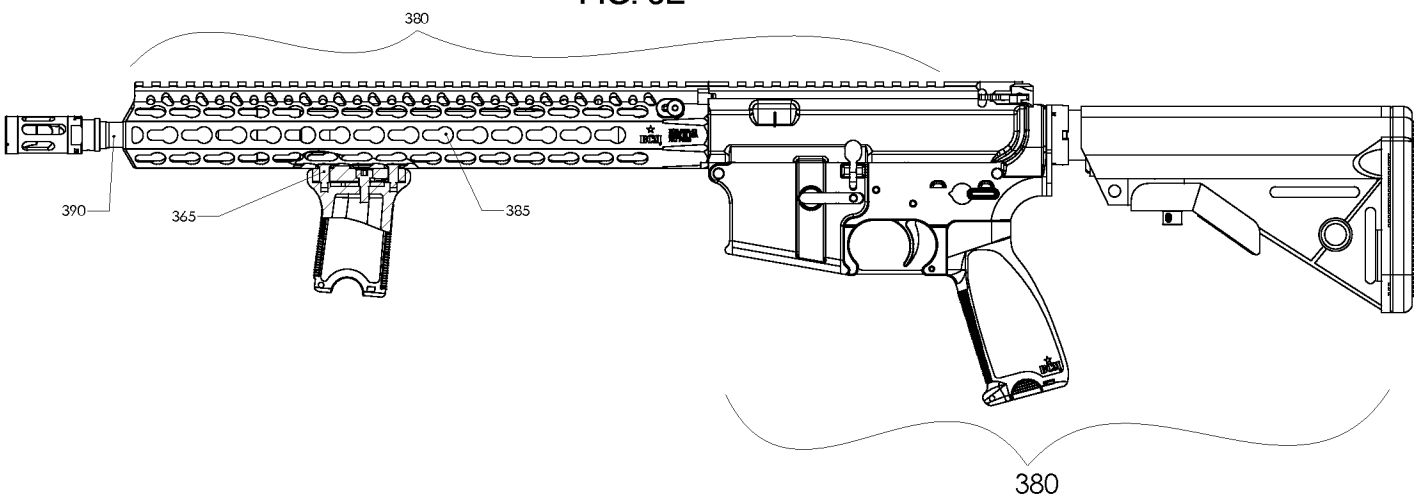
FIG. 3E illustrates a cross-sectional view of an exemplary fully assembled keyhole mounted accessory mounted to an exemplary firearm using a throw lever with helical pads.

Referring now to FIG. 3E, illustrating a cross-sectional view of an exemplary fully assembled keyhole mounted accessory mounted to an exemplary firearm using an anchor beam and throw lever, throw lever 315 is shown in the open position. Anchors 330 are secured to an accessory rail 345. The head of an anchor 330 fits through the circular portion of a hole 350. When the user slides grip body 300 forward (toward the end of the firearm barrel 355) on the accessory rail 345, the body of anchor 330 interfaces with the narrow portion of hole 350, securing the anchor in place. The user may remove the keyhole mounted accessory by sliding grip body 300 backward (toward the firearm stock 360) and lowering the head of anchor 330 out of the circular portion of hole 350 of accessory rail 345.

Keyhole Mounted Accessory with Anchor Beam and Threaded Throw Lever

Figure 4A:
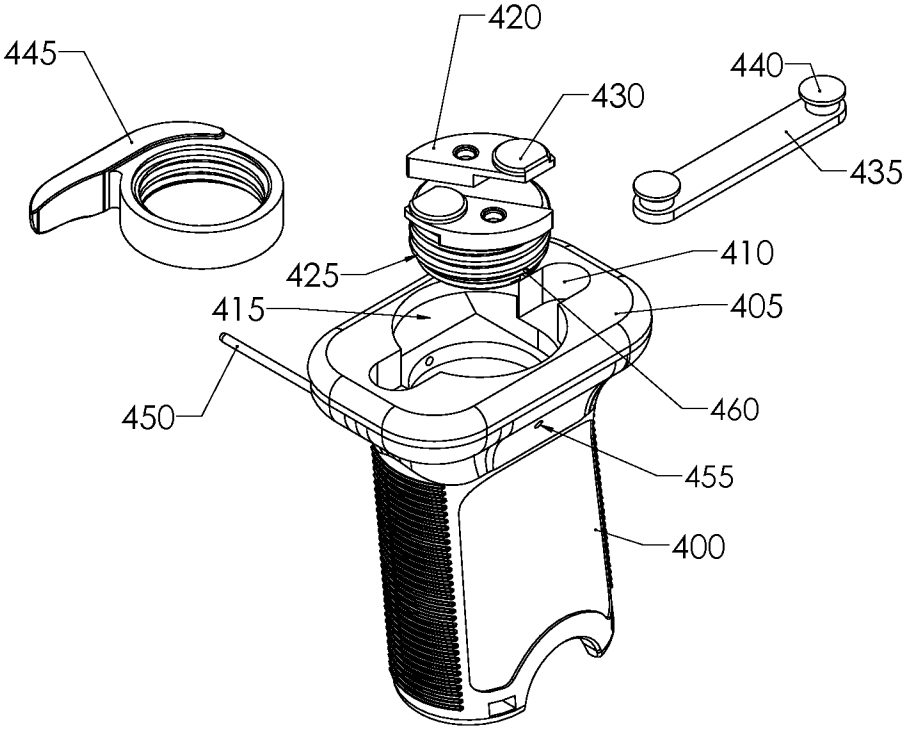
FIG. 4A illustrates an exploded view of an exemplary keyhole mounted accessory using an anchor beam and a threaded throw lever.

Referring now to FIG. 4A, illustrating an exploded view of an exemplary keyhole mounted accessory using an anchor beam and a threaded throw lever, a grip body 400 (which would be the main body of a different type of accessory) has an integrated top plate 405. Top plate 405 has an aperture 410 containing a slit 415 that creates a void between the inside of aperture 410 (shown) and the outside wall of grip body 400 (not shown). Plug 420 has a lower threaded portion 425 and an upper portion attached to which are two split, semi-circular plates set at different heights. Recoil lugs, one of which is labeled 435, are integrated into the top of plug 420.

The circular portion of throw lever 445, which contains a circular, threaded aperture in its center, is placed through slit 415 and into aperture 410. Anchor beam 435, which contains anchors, one of which is labeled 440, may interlock with the split plates of plug 420, such that recoil lugs 430 and anchors 440 are parallel. Plug 420 may then be lowered into aperture 410 and screwed into the circular portion of throw lever 445.

Roll pin 450 may be used to retain plug 420 in grip body 400 after assembly using two small apertures 455 on either side of grip body 400. The bottom of the lower threaded portion 425 contains a diametric slot 460. Roll pin 450 may be inserted into a first small aperture 455 (shown) on the grip body 400, through the diametric slot 460, and into a second small aperture 455 (not shown) on the opposite outside wall of the grip body 400.

Figure 4B:
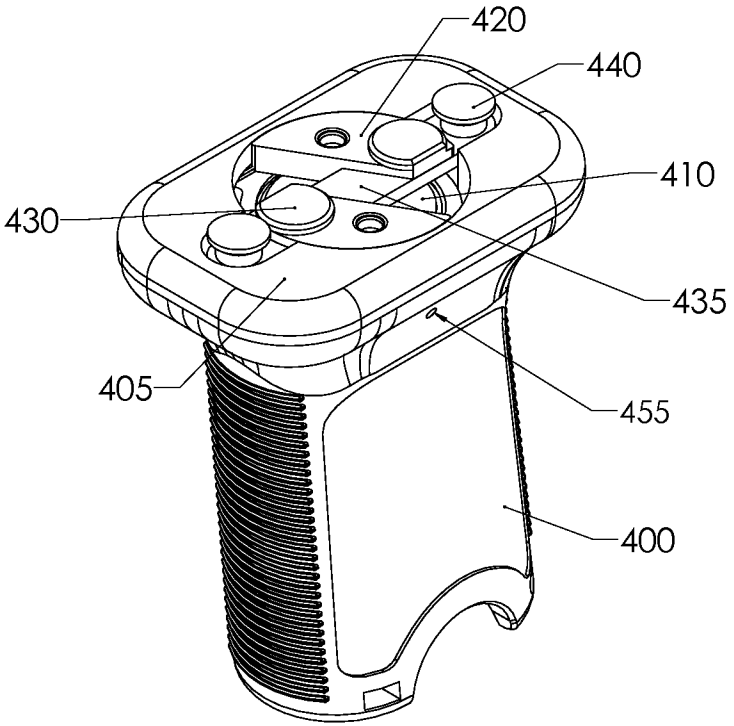
FIG. 4B illustrates a perspective view of an exemplary fully assembled keyhole mounted accessory using an anchor beam and a threaded throw lever.

Referring now to FIG. 4B, illustrating a perspective view of an exemplary fully assembled keyhole mounted accessory using an anchor beam and a threaded throw lever, throw lever 445 of FIG. 4A is shown in a closed position. The threaded portion of throw lever 445 (not shown) pulls plug 420 and anchor beam 435 down into aperture 410. Anchors 440 are thus depressed, and are lowered such that they are nearly flush with top plate 405.

Figure 4C:
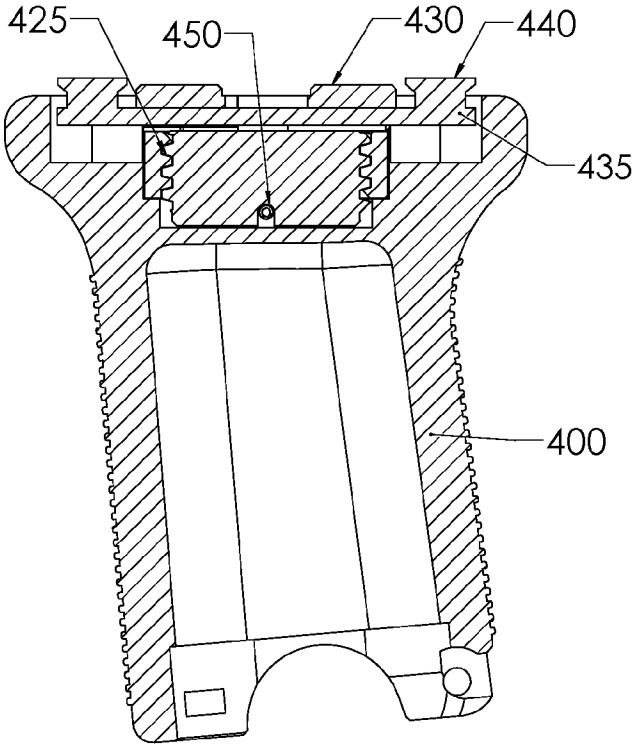
FIG. 4C illustrates a cross-sectional view of an exemplary fully assembled keyhole mounted accessory using an anchor beam and a threaded throw lever.

Referring now to FIG. 4C, illustrating a cross-sectional view of an exemplary fully assembled keyhole mounted accessory using an anchor beam and a threaded throw lever, anchor beam 435 is depressed into the aperture 410 of grip body 400 by way of the circular portion of throw lever 445 and plug 420. Plug 420 is held in place by roll pin 450, which enters through the side of grip body 400, passes through a slot 460 the bottom of plug 420, and ends at the opposite outside wall of grip body 400. In the depressed position shown in FIG. 4C, anchors 440 are lowered such that they are nearly flush with top plate 405.

Figure 4D:
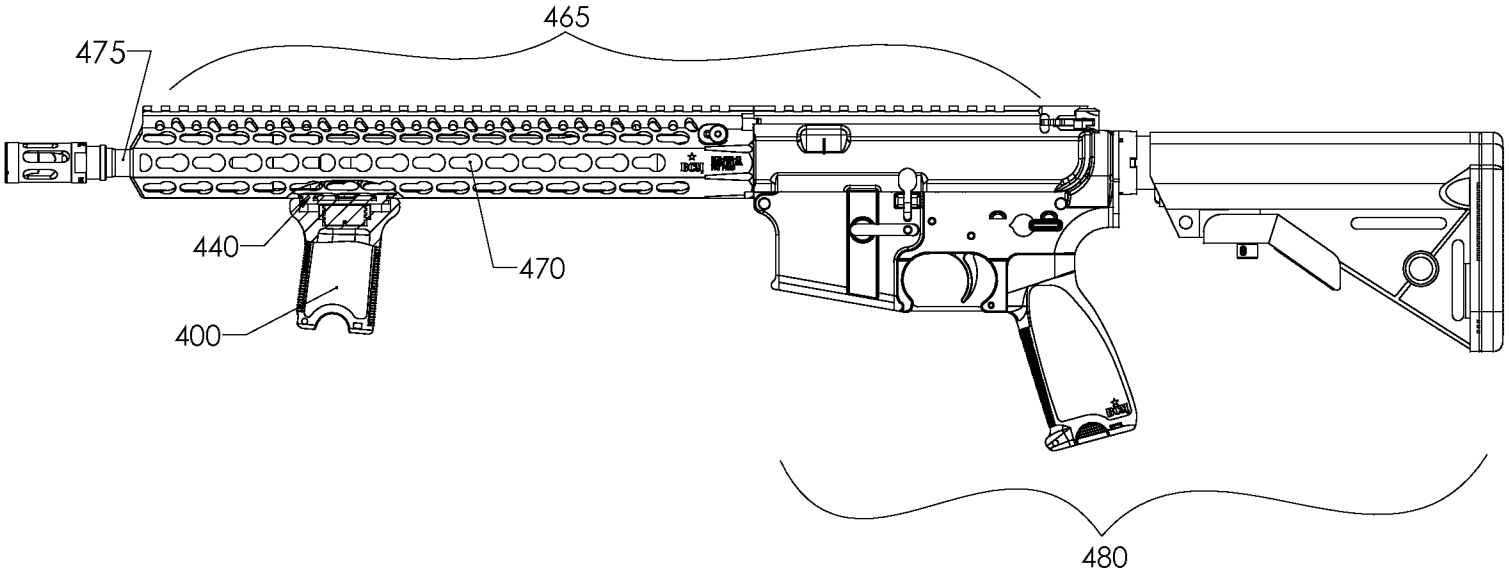
FIG. 4D illustrates a cross-sectional view of an exemplary fully assembled keyhole mounted accessory mounted to an exemplary firearm using an anchor beam and a threaded throw lever.

Referring now to FIG. 4D, illustrating a cross-sectional view of an exemplary fully assembled keyhole mounted accessory mounted to an exemplary firearm using an anchor beam and a threaded throw lever, throw lever 445 is shown in the open position. Anchors 440 are secured to an accessory rail 465. The head of an anchor 440 fits through the circular portion of a hole 470. When the user slides grip body 400 forward (toward the end of the firearm barrel 475) on the accessory rail 465, the body of anchor 440 interfaces with the narrow portion of hole 470, securing the anchor in place. The user may remove the keyhole mounted accessory by sliding grip body 400 backward (toward the firearm stock 480) and lowering the head of anchor 440 out of the circular portion of hole 470 of accessory rail 465.

Keyhole Mounted Accessory with Threaded Beam

Figure 5A:
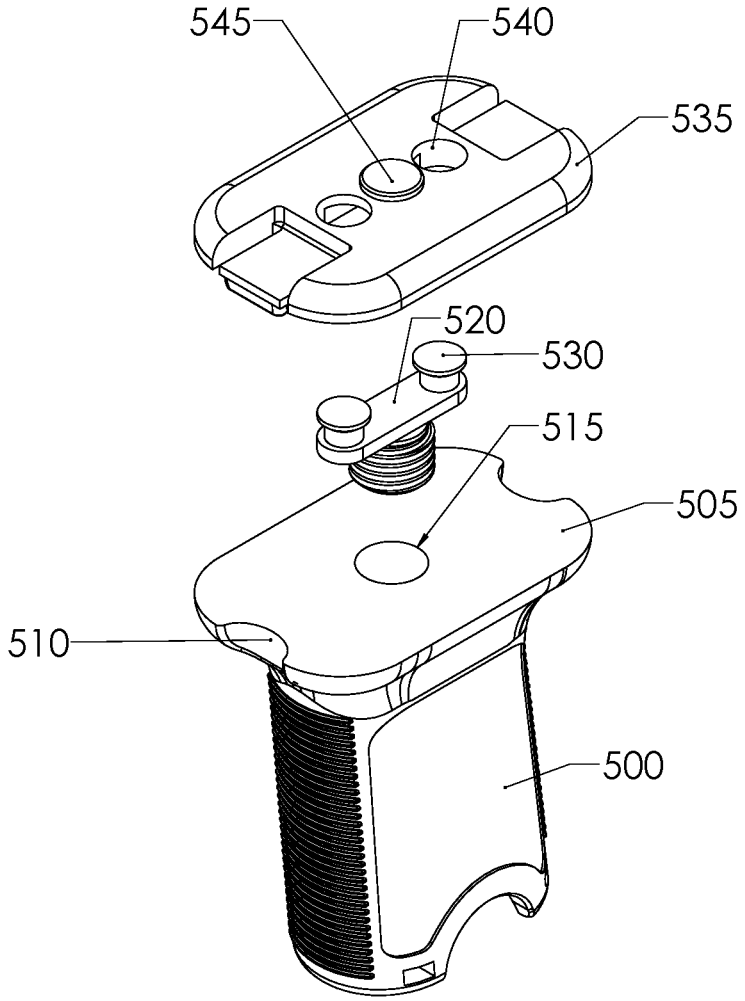
FIG. 5A illustrates an exploded view of an exemplary keyhole mounted accessory using a threaded beam.

Referring now to FIG. 5A, illustrating an exploded view of an exemplary keyhole mounted accessory using a threaded beam, a grip body 500 (which would be the main body of a different type of accessory) has an integrated top plate 505. Top plate 505 has two locking tab recesses, one of which is labeled 510. Top plate 505 contains an aperture 515 in its center. Anchor beam 520 has a threaded plug 525 that may be lowered into aperture 515. Anchors, one of which is labeled 630, are integrated into the top of anchor beam 520.

Cover plate 535 contains apertures, one of which is labeled 540, into which anchors 530 fit when cover plate 535 is lowered over anchor beam 520. Cover plate 535 further contains an integrated recoil lug 545.

Grip body 500 may be twisted on to threaded plug 525 to tighten anchor beam 520 to grip body 500 and cover plate 535 to anchor beam 520. Thus, cover plate 535 interfaces with top plate 505.

Either side of cover plate 535 contains locking tabs, one of which is labeled 650. When cover plate 535 is interfaced with top plate 505, locking tabs 550 lock into locking tab recesses 510 to secure cover plate 535 in place. Relief in the design allows a user to bend locking tabs 550 to release them and unlock cover plate 535 from the grip assembly.

Figure 5B:
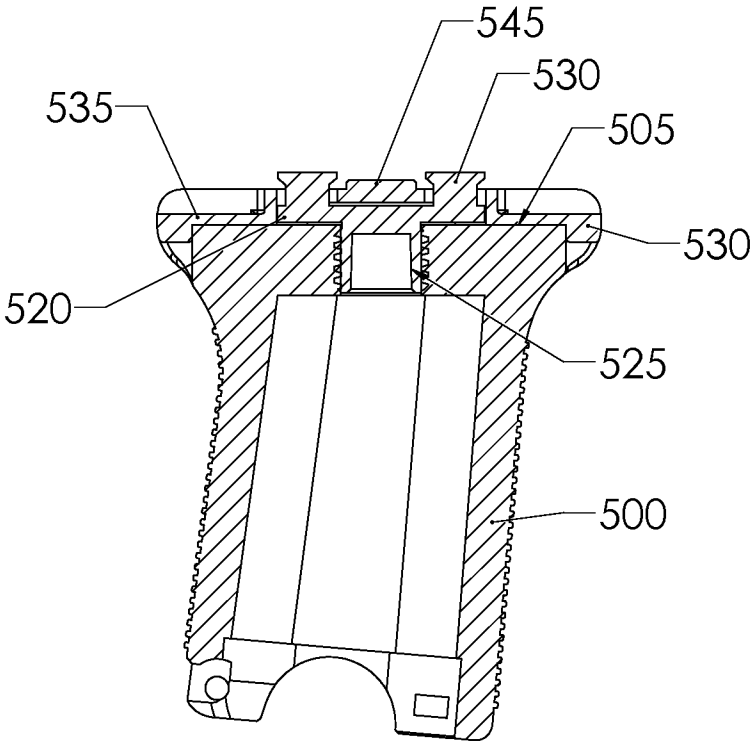
FIG. 5B illustrates a cross-sectional view of an exemplary fully assembled keyhole mounted accessory using a threaded beam.

Referring now to FIG. 5B, illustrating a cross-sectional view of an exemplary fully assembled keyhole mounted accessory using a threaded beam, anchor beam 520 and cover plate 535 interface with top plate 505 of grip body 500. Locking tabs 650 secure cover plate to grip body 500. Threaded plug 525 is screwed into grip body 500, securing the entire grip assembly in place.

Figure 5C:
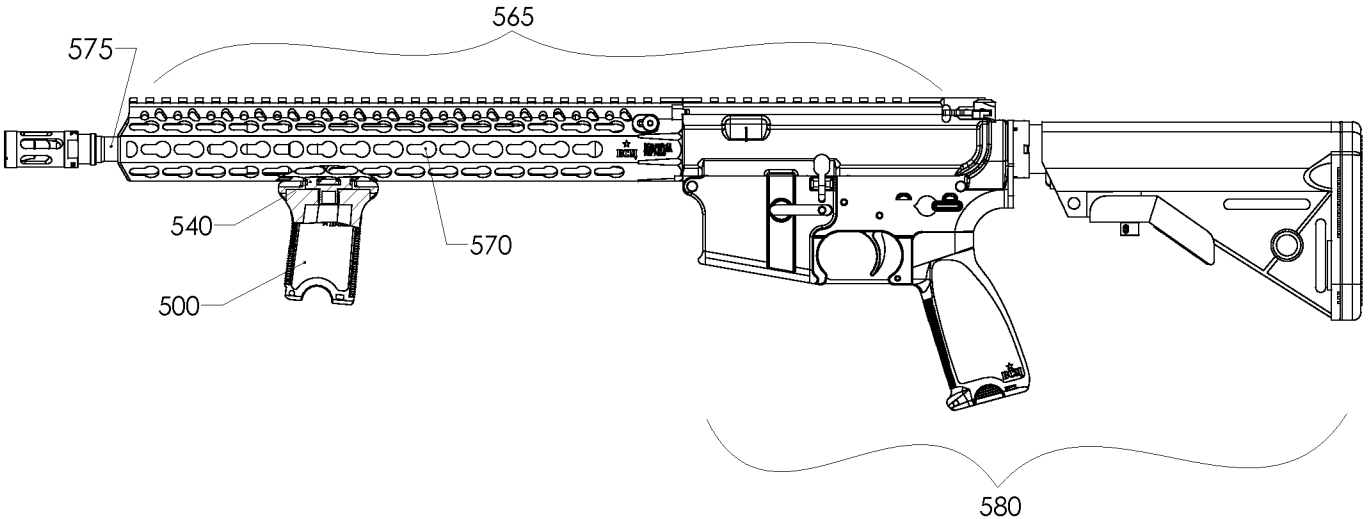
FIG. 5C illustrates a cross-sectional view of an exemplary fully assembled keyhole mounted accessory mounted to an exemplary firearm using a threaded beam.

Referring now to FIG. 5C, illustrating a cross-sectional view of an exemplary fully assembled keyhole mounted accessory mounted to an exemplary firearm using a threaded beam, the head of an anchor 530 fits through the circular portion of a hole 555. When the user slides grip body 500 forward (toward the end of the firearm barrel 560) on the accessory rail 565, the body of anchor 530 interfaces with the narrow portion of hole 555, securing the anchor in place. The user may remove the keyhole mounted accessory by sliding grip body 500 backward (toward the firearm stock 565) and lowering the head of anchor 530 out of the circular portion of hole 555 of accessory rail 565.

Keyhole Mounted Accessory with Threaded Beam and Slide Lock

Figure 6A:
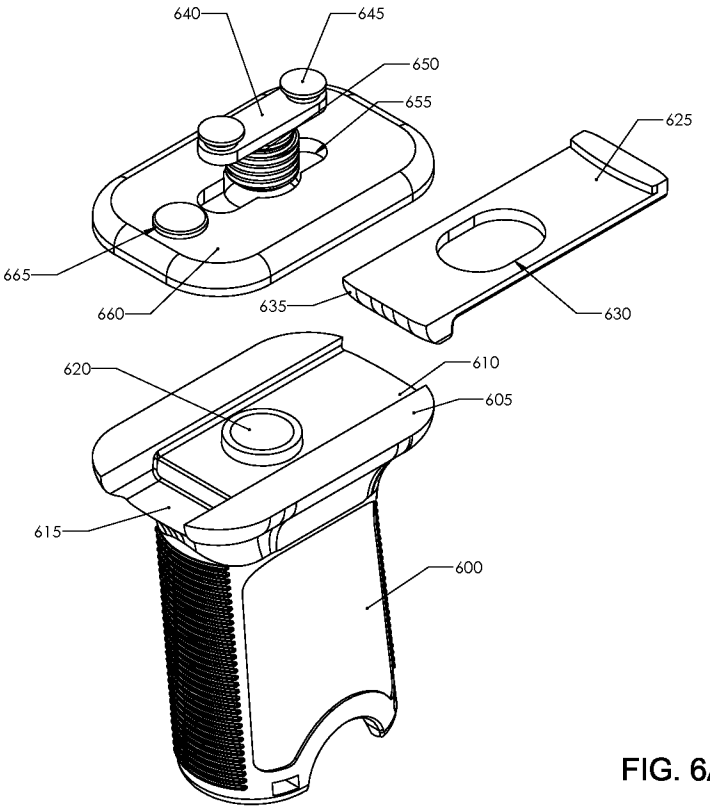
FIG. 6A illustrates an exploded view of an exemplary keyhole mounted accessory using a threaded beam and slide lock.

Referring now to FIG. 6A, illustrating an exploded view of an exemplary keyhole mounted accessory using a threaded beam and slide lock, a grip body 600 (which would be the main body of a different type of accessory) has an integrated top plate 605. Top plate 605 has a sliding lock recess 610 and a locking tab recess 615. Top plate 605 contains a threaded aperture 620 in its center.

Sliding lock plate 625 has an aperture 630 in its center and a locking tab 635 on one end. Sliding lock plate 625 slides into sliding lock recess 610, and locking tab 635 locks sliding lock plate 625 into place on grip body 600 by interfacing with locking tab recess 615.

Anchor beam 640 has integrated anchors, one of which is labeled 645 and a threaded plug 650. Threaded plug 650 may be threaded through aperture 655 of cover plate 660. Cover plate 660 has an integrated recoil lug 665.

Figure 6B:
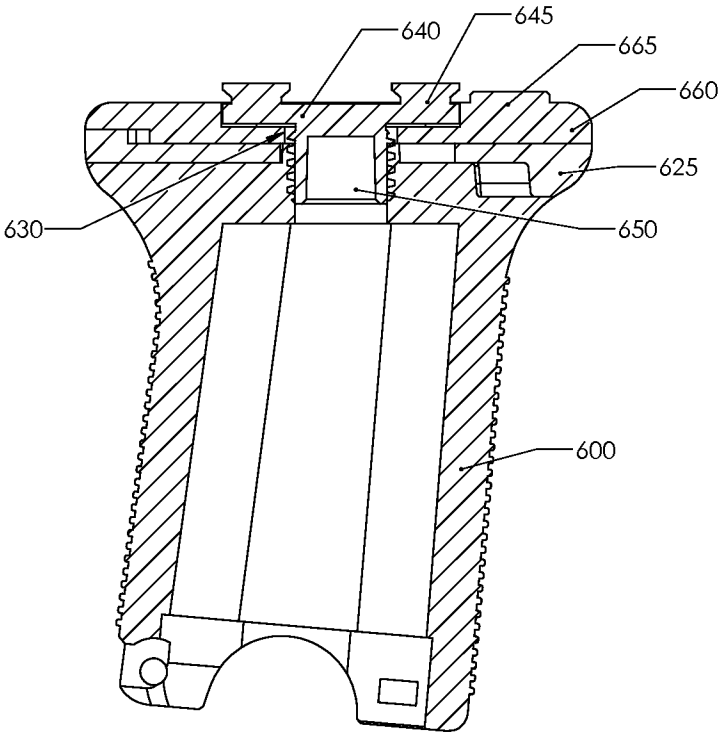
FIG. 6B illustrates a cross-sectional view of an exemplary fully assembled keyhole mounted accessory using a threaded beam and slide lock.

Referring now to FIG. 6B, illustrating a cross-sectional view of an exemplary fully assembled keyhole mounted accessory using a threaded beam and slide lock, anchor beam 640 and cover plate 660 interface with top plate 605 of grip body 600. Threaded plug 650 may then be threaded through aperture 630 and threaded aperture 620, securing cover plate 660 by twisting grip body 600. A user may disengage sliding lock plate 625 by pushing locking tab 635 inward toward the center of grip body 600.

Figure 6C:
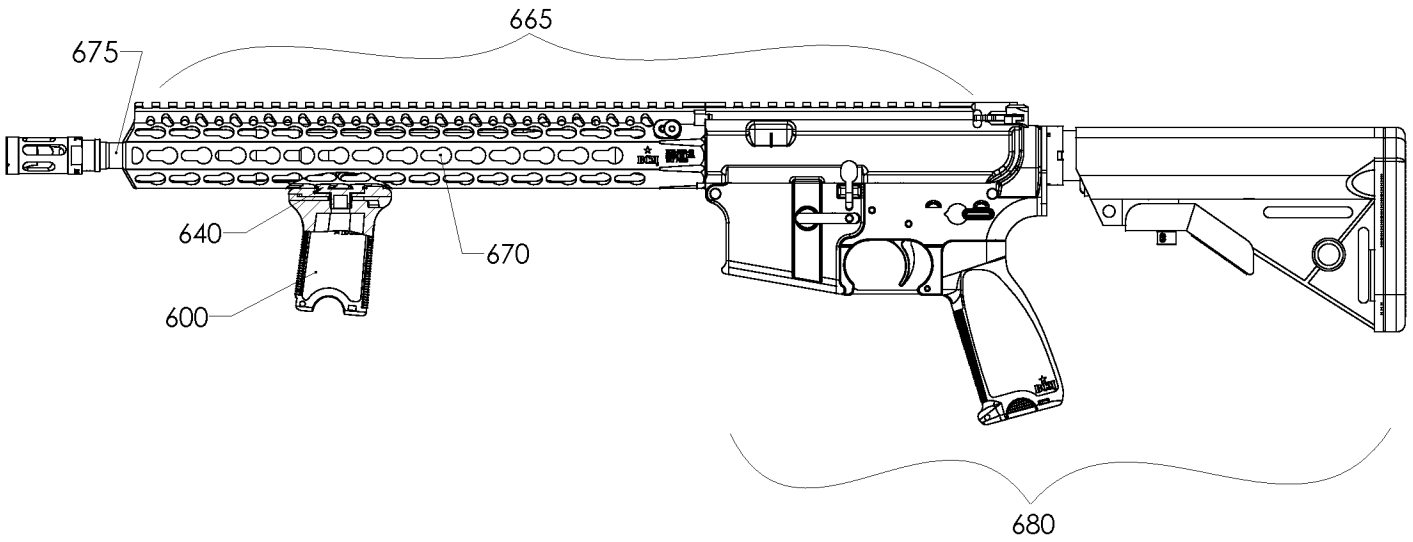
FIG. 6C illustrates a cross-sectional view of an exemplary fully assembled keyhole mounted accessory mounted to an exemplary firearm using a threaded beam and slide lock.

Referring now to FIG. 6C, illustrating a cross-sectional view of an exemplary fully assembled keyhole mounted accessory mounted to an exemplary firearm using a threaded beam and slide lock, the head of an anchor 645 fits through the circular portion of a hole 670. When the user slides grip body 600 forward (toward the end of the firearm barrel 675) on the accessory rail 680, the body of anchor 645 interfaces with the narrow portion of hole 670, securing the anchor in place. The user may remove the keyhole mounted accessory by sliding grip body 600 backward (toward the firearm stock 685) and lowering the head of anchor 645 out of the circular portion of hole 670 of accessory rail 680.

Keyhole Mounted Accessory with Spring Tension Lock-Plunger

Figure 7A:
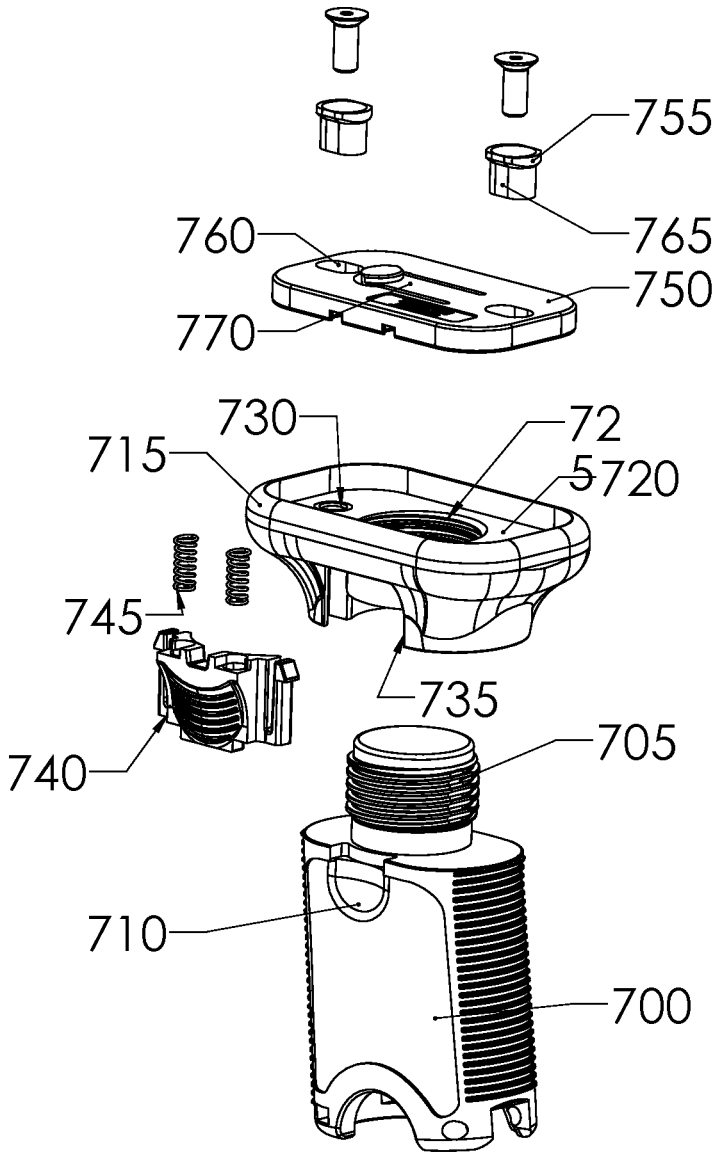
FIG. 7A illustrates a top-down exploded view of an exemplary keyhole mounted accessory using a spring tension lock-plunger.

Referring now to FIG. 7A, illustrating an exploded view of an exemplary keyhole mounted accessory using a spring tension lock-plunger, a grip body 700 (which would be the main body of a different type of accessory) has a threaded bolt 705 protruding from the top. Grip body 700 also has a recess 710 on at least one side.

The upper portion of an intermediate body 715 is hollow and contains base 720. Intermediate body 715 contains a large hollow, threaded cylinder 725, which creates an aperture in base 720 and into which bolt 705 may be inserted. Intermediate body 715 further contains at least one small, hollow threaded cylinder, one of which is labeled 730, which also creates an aperture in base 720. Adjacent to large cylinder 725 is a hollow, rectangular aperture 735 in base 720.

When grip body 700 is fully rotated to interlock with intermediate body 715, such that bolt 705 is threaded through large cylinder 725, rectangular aperture 735 aligns with recess 710.

Lock-plunger 740 contains springs, one of which is labeled 745, for tension. Lock-plunger 740 interfaces with grip body 700 and intermediate body 715 and locks into recess 710 and rectangular aperture 735, respectively.

Top plate 750 is affixed to intermediate body 715 by one or more anchor screws, such as a KeyMod™ anchor screw, one of which is labeled 755. Top plate 750 contains one or more apertures 760 through which anchor nuts 765 and anchor screws 755 may be threaded.

Intermediate body 715 further contains recoil lug tab 770. When grip body 700 is not coupled to intermediate body 715, recoil lug tab 770 is depressed below the upper surface of top plate 750.

Figure 7B:
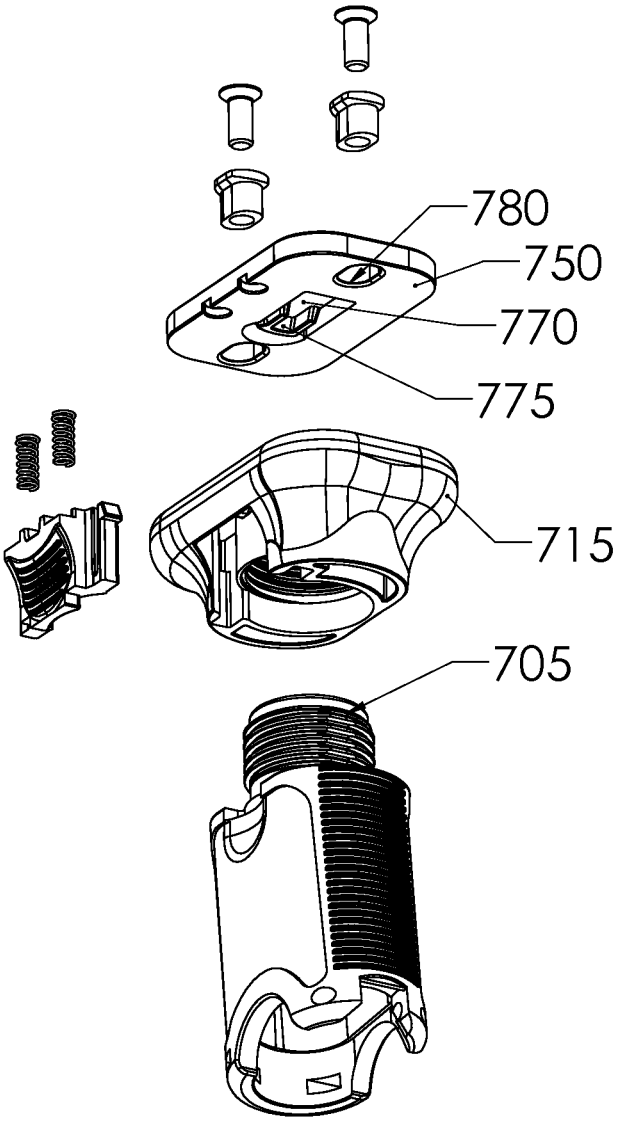
FIG. 7B illustrates a bottom-up exploded view of an exemplary keyhole mounted accessory using a spring tension lock-plunger.

FIG. 7B illustrates a bottom-up view of top plate 750 of an exemplary keyhole mounted accessory using a spring tension lock-plunger. When grip body 700 and intermediate body 715 are interlocked, a tooth 775 interfaces with the top surface of threaded bolt 705, which pushes recoil lug tab 770 such that recoil lug can interface with the mounting surface of a firearm (see FIG. 7E below). Top plate 750 further contains cylindrical apertures 780 to hold the upper portion of springs 745.

Figure 7C:
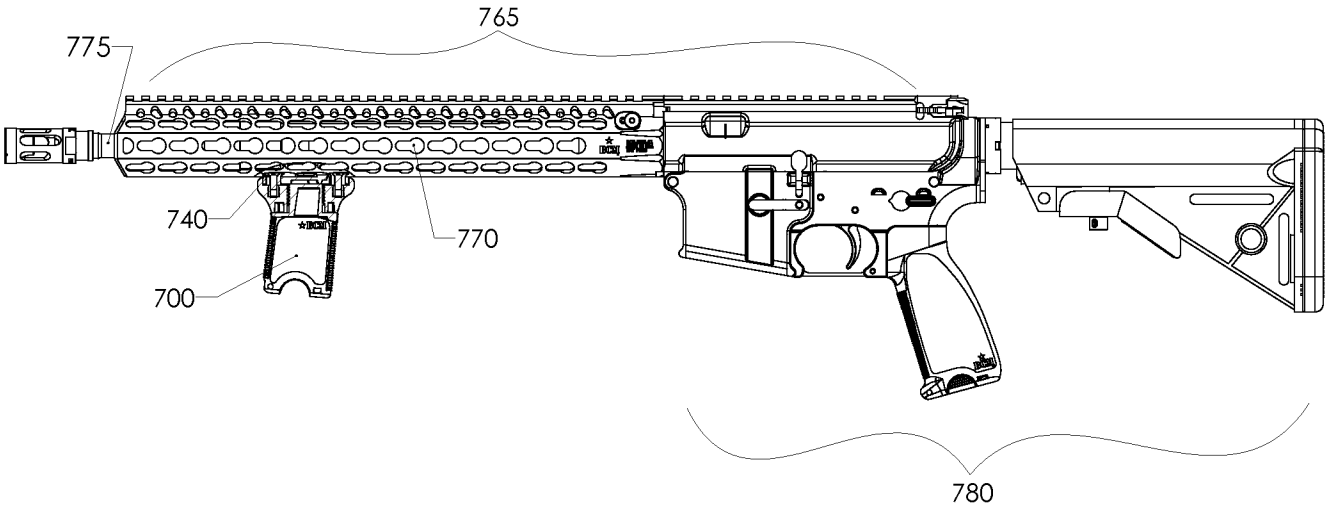
FIG. 7C illustrates a cross-sectional view of an exemplary fully assembled keyhole mounted accessory mounted to an exemplary firearm using a spring tension lock-plunger.

Referring now to FIG. 7C, illustrating a cross-sectional view of an exemplary fully assembled keyhole mounted accessory mounted to an exemplary firearm using a spring tension lock-plunger, anchor screws 755 protrude from the top of top plate 750. Grip body 700 is secured to intermediate body 715 and held in place using interlocking spring tension lock plunger 740. Anchor screws 755 are secured to an accessory rail 785. The head of an anchor screw 755 fits through the circular portion of a hole 790. When the user slides grip body 700 forward (toward the end of the firearm barrel 795) on the accessory rail 785, the body of anchor screw 755 interfaces with the narrow portion of hole 790, securing the anchor screw in place. The user may remove the keyhole mounted accessory by sliding grip body 700 backward (toward the firearm stock) and lowering the head of anchor screw 755 out of the circular portion of hole 790 of accessory rail 785

Keyhole Mounted Accessory with Anchor Studs

Figure 8A:
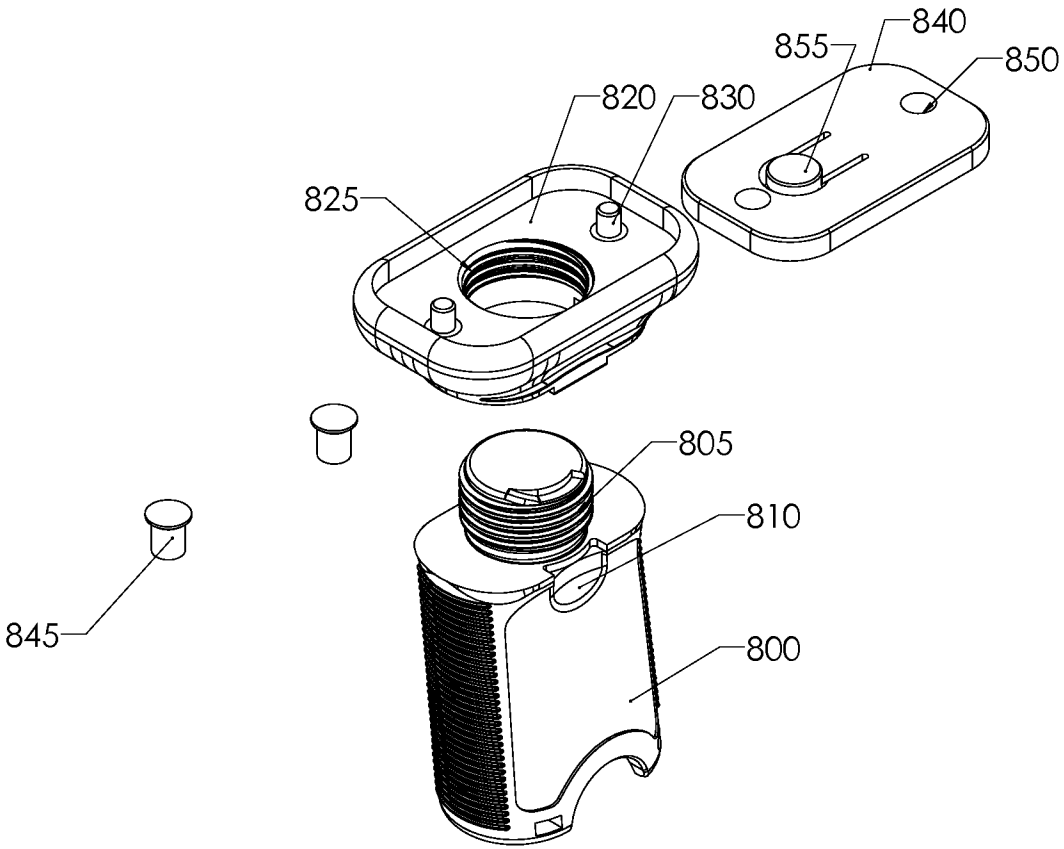
FIG. 8A illustrates an exploded view of an exemplary keyhole mounted accessory using anchor studs.

Referring now to FIG. 8A, illustrating an exploded view of an exemplary keyhole mounted accessory using anchor studs, a grip body 800 (which would be the main body of a different type of accessory) has a threaded bolt 805 protruding from the top. Threaded bolt 805 has a sloped ramp on its top surface, which acts as a ¼-turn stop. Grip body 800 also has a recess 810 on at least one side.

The upper portion of an intermediate body 815 is hollow and contains base 820. Intermediate body 815 contains a large hollow, threaded cylinder 825, which creates an aperture in base 820 and into which bolt 805 may be inserted. Intermediate body 815 further contains at least one molded-in anchor stud 830, which protrudes from base 820, and a tab 835 that extends from the bottom portion of one side.

When grip body 800 is fully rotated to interlock with intermediate body 815, such that bolt 805 is threaded through large cylinder 825, tab 835 interlocks with recess 810.

Top plate 840 is affixed to intermediate body 815 by one or more anchors, such as a KeyMod™ anchors, one of which is labeled 845. Top plate 840 contains one or more apertures 850 through which anchors 845 may be threaded. Anchors 845 have hollow bodies, such that molded-in anchor studs 830 fit into anchors 845 to secure the anchors 845 in place, therefore securing top plate 840 to intermediate body 815.

Intermediate body 815 further contains recoil lug tab 855. When grip body 800 is not coupled to intermediate body 815, recoil lug tab 855 is depressed below the upper surface of top plate 840.

Figure 8B:
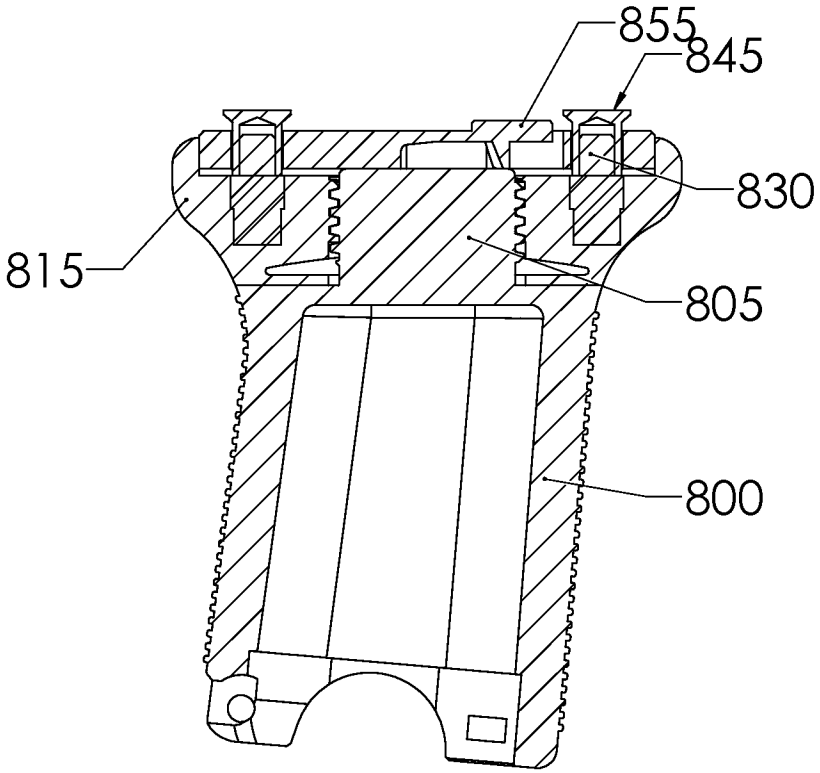
FIG. 8B illustrates a cross-sectional view of an exemplary fully assembled keyhole mounted accessory using anchor studs.

Referring now to FIG. 8B, illustrating a cross-sectional view of an exemplary fully assembled keyhole mounted accessory using anchor studs. When grip body 800 and intermediate body 815 are interlocked, the sloped ramp on threaded bolt 805 pushes on recoil lug tab 855, such that recoil lug can interface with the mounting surface of a firearm (see FIG. 8D below).

Figure 8C:
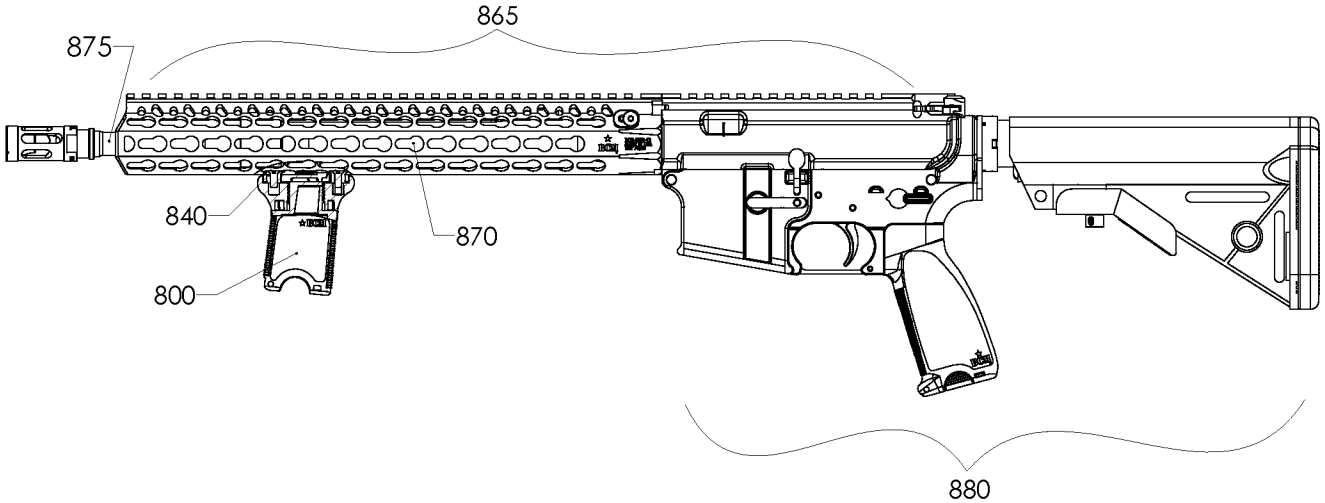
FIG. 8C illustrates a cross-sectional view of an exemplary fully assembled keyhole mounted accessory mounted to an exemplary firearm using anchor studs.

Referring now to FIG. 8C, illustrating a side view of a fully assembled keyhole mounted accessory using anchor studs, anchors 845 protrude from the top of top plate 840. Grip body 800 is secured to intermediate body 815 and held in place using interlocking tab 835. F850

Referring now to FIG. 8D, illustrating a cross-sectional view of an exemplary fully assembled keyhole mounted accessory mounted to an exemplary firearm using anchor studs, anchors 845 are secured to an accessory rail 865. The head of an anchor 845 fits through the circular portion of a hole 870. When the user slides grip body 800 forward (toward the end of the firearm barrel 875) on the accessory rail 865, the body of anchor 845 interfaces with the narrow portion of hole 870, securing the anchor in place. The user may remove the keyhole mounted accessory by sliding grip body 800 backward (toward the firearm stock) and lowering the head of anchor 845 out of the circular portion of hole 870 of accessory rail 865.

It is contemplated that the above-described locking mechanisms (i.e., anchors and helical pads, anchor beam and throw lever, throw lever with helical pads, anchor beam and threaded throw lever, threaded beam, threaded beam and slide lock, spring tension lock-plunger, and anchor studs) may be utilized to attach other accessories to a rail besides keyhole mounted accessories, including for example lights mounts, optic mounts, bipod mounts, sling mounts, infrared/laser aiming device, and similar accessories that are traditionally attached to a Picatinny rail.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. To the contrary, the present descriptions are intended to cover alternatives, modifications, and equivalents as may be included within the spirit and scope of the invention as defined by the appended claim and otherwise appreciated by one of ordinary skill in the art.

What is claimed is:

1. A firearm accessory mounting system, the system comprising:

a main body having a top surface and a side surface, the top surface of the main body including an integral bolt protruding from the top surface, and the side surface of the main body including a recess;

an intermediate body coupled to the main body, the intermediate body including a base, the base having a hollow cylinder disposed between a top surface and a bottom surface and an aperture disposed in a side surface, wherein the hollow cylinder of the intermediate body is coupled to the integral bolt of the main body;

a lock-plunger disposed between the recess of the main body and the aperture of the intermediate body, the lock-plunger having a top end and a bottom end and being moveable between a biased position and an unbiased position, wherein the lock-plunger is tensioned in place by one or more springs with the top end of the lock-plunger abutting the recess of the main body and the bottom end abutting the aperture of the intermediate body and prevents rotational decoupling of the main body from the intermediate body when in the biased position, and the lock-plunger permits rotational decoupling of the main body from the intermediate body when the lock-plunger is forced upwardly into the unbiased position and the bottom end of the lock-plunger is forced out of abutment with the recess of the main body; and a top plate coupled to the intermediate body by one or more anchors, the one or more anchors protruding from the top plate to engage a firearm accessory rail of a firearm.

2. The system of claim 1, wherein the aperture of the base is rectangular.

3. The system of claim 1, wherein the aperture of the base aligns with the recess of the main body when the intermediate body is coupled to the main body.

4. The system of claim 1, wherein the bolt protruding from the first end of the main body is threaded.

5. The system of claim 1, wherein the hollow cylinder of the base is threaded.

6. The system of claim 1, wherein the one or more anchors include an anchor that mates with a keyhole-shaped void.

7. The system of claim 1, wherein the one or more anchors include at least two anchors that respectively mate with at least two keyhole-shaped voids disposed in an accessory rail of a firearm.

8. The system of claim 1, wherein the intermediate body further includes a recoil lug tab.

9. The system of claim 8, wherein the recoil lug tab is depressed below an upper surface of the top plate when the main body is coupled to the intermediate body.

10. The system of claim 1, wherein the top plate further includes one or more apertures that slidably mate with the one or more springs.

11. A firearm accessory mounting system, the system comprising:

a main body having a top surface and a side surface, the top surface of the main body including an integral bolt protruding from the top surface, and the side surface of the main body including a recess;

an intermediate body coupled to the main body, the intermediate body including a base, the base having a hollow cylinder disposed between a top surface and a bottom surface and an aperture disposed in a side surface, wherein the hollow cylinder of the intermediate body is coupled to the integral bolt of the main body;

a lock-plunger disposed between the recess of the main body and the aperture of the intermediate body, the lock-plunger having a top end and a bottom end and being moveable between a biased position and an unbiased position, wherein the lock-plunger is tensioned in place by one or more springs with the top end abutting the recess of the main body and the bottom end abutting the aperture of the intermediate body and prevents rotational decoupling of the main body from the intermediate body when in the biased position, and the lock-plunger permits rotational decoupling of the main body from the intermediate body when the lock-plunger is forced upwardly into the unbiased position and the bottom end of the lock-plunger is forced out of abutment with the recess of the main body; and one or more anchors coupled to the intermediate body, the one or more anchors protruding from the intermediate body to engage at a firearm accessory rail of a firearm.

12. The system of claim 11, wherein the aperture of the base is rectangular.

13. The system of claim 11, wherein the aperture of the base aligns with the recess of the main body when the intermediate body is coupled to the main body.

14. The system of claim 11, wherein the bolt protruding from the first end of the main body is threaded.

15. The system of claim 11, wherein the hollow cylinder of the base is threaded.

16. The system of claim 11, wherein the one or more anchors include an anchor that mates with a keyhole-shaped void.

17. The system of claim 11, wherein the one or more anchors includes at least two anchors that respectively engage at least two keyhole-shaped voids disposed in a firearm accessory rail of a firearm.

18. The system of claim 11, wherein the intermediate body further includes a recoil lug tab.

19. The system of claim 18, wherein the recoil lug tab is depressed below an upper surface of the intermediate body when the main body is coupled to the intermediate body.

20. The system of claim 11, wherein the intermediate body further includes one or more apertures that slidably mate with the one or more springs.

* * * * *